US007249639B2

(12) United States Patent
Belik

(10) Patent No.: US 7,249,639 B2
(45) Date of Patent: Jul. 31, 2007

(54) AUTOMATED ARM FOR POSITIONING OF DRILLING TOOLS SUCH AS AN IRON ROUGHNECK

(75) Inventor: Jaroslav Belik, Pearland, TX (US)

(73) Assignee: National Oilwell, L.P., Houston, TX (US)

( * ) Notice: Subject to any disclaimer, the term of this patent is extended or adjusted under 35 U.S.C. 154(b) by 0 days.

(21) Appl. No.: 11/334,233

(22) Filed: Jan. 18, 2006

(65) Prior Publication Data

US 2006/0118335 A1 Jun. 8, 2006

Related U.S. Application Data

(63) Continuation of application No. 10/916,164, filed on Aug. 11, 2004.

(60) Provisional application No. 60/499,087, filed on Aug. 29, 2003.

(51) Int. Cl.
*E21B 19/16* (2006.01)

(52) U.S. Cl. ..... 175/162; 166/85.1; 408/237

(58) Field of Classification Search ..... 408/234, 408/236, 237; 175/220, 85, 162; 166/77.51, 166/85.1; 414/745.1, 22.51, 22.63
See application file for complete search history.

(56) References Cited

U.S. PATENT DOCUMENTS

| | | | | |
|---|---|---|---|---|
| 4,234,150 A | | 11/1980 | Mee et al. | 248/281.11 |
| 4,274,778 A | | 6/1981 | Putnam et al. | 414/22.71 |
| 4,345,864 A | | 8/1982 | Smith et al. | 414/22.63 |
| 4,548,544 A | | 10/1985 | Van Appledorn | 198/750.11 |
| 4,725,179 A | | 2/1988 | Woolslayer et al. | 414/22.65 |
| 4,843,945 A | | 7/1989 | Dinsdale | 81/57.34 |
| 4,975,016 A | * | 12/1990 | Pellenc et al. | 414/501 |
| 6,206,096 B1 | | 3/2001 | Belik | 166/77.51 |
| 6,253,845 B1 | | 7/2001 | Belik | 166/77.51 |
| 6,318,214 B1 | | 11/2001 | Buck | 81/57.35 |

FOREIGN PATENT DOCUMENTS

WO WO 200066875 A1 11/2000

* cited by examiner

*Primary Examiner*—David Bagnell
*Assistant Examiner*—Daniel P Stephenson
(74) *Attorney, Agent, or Firm*—Howrey LLP

(57) ABSTRACT

The invention relates to an apparatus for moving an Iron Roughneck into position to allow making-up or breaking-out of threaded joints in a drill string. The apparatus may also be used to move other drilling equipment into position on the centerline of the well or at mouse holes. A self-balanced, dual synchronized parallelogram arm is utilized to accomplish the movement of the devices. Hydraulic or pneumatic cylinders are used for extension and retraction of the arm rather than to support the tool. The arm may hold the tool in any position without cylinder assistance. The linkage in the synchronized parallelogram may be accomplished by gears, links, slots, or rollers.

4 Claims, 6 Drawing Sheets

AUTOMATED ARM FOR POSITIONING OF DRILLING TOOLS SUCH AS AN IRON ROUGHNECK

This application is a continuation of co-pending U.S. Non-provisional Application No. 10/916,164 entitled "Automated Arm For Positioning Of Drilling Tools Such As An Iron Roughneck," filed Aug. 11, 2004 by Jaroslav Belik, which claims benefit of priority to U.S. Provisional Application No. 60/499,087, filed Aug. 29, 2003, each application herein incorporated by reference in its entirety.

FIELD OF THE INVENTION

The present invention relates to a positioning device particularly useful in the oil and gas industry. In particular, the invention relates to a positioning device that allows for the positioning of drilling tools about a rig floor with more efficiency and with less risk to rig personnel than previous positioning devices.

BACKGROUND OF THE INVENTION

In the oil and gas industry, a drill string is used by a drilling rig to drill a wellbore. The drillstring is typically composed of drillpipe and a bottomhole assembly; the latter including the drill bit, drill collars and other drilling related tools. An automated apparatus generally known as an "Iron Roughneck," may be utilized to make-up and break-out threaded joints of drill pipe in a drill string. Iron Roughnecks have been used in the drilling industry for several years and are commercially available from a number of suppliers. For example, several Iron Roughnecks are manufactured and marketed by National Oilwell, L.P. in Houston, Tex.

An Iron Roughneck generally comprises a two-piece wrench unit and a spinner unit. The spinner rotates a joint of drill pipe relative to a second joint to either screw the pin end of the tool joint of the first joint of drill pipe into the box end of the tool joint of the second joint, or to unscrew the tool joints of the two joints of drill pipe. The wrench unit provides the torque necessary to make-up or break-out the connection. The bottom wrench, which serves as a back-up wrench, grasps the tool joint of the drill pipe suspended in the rotary table or mousehole. The upper wrench grasps the tool joint of the pipe suspended from the derrick and applies either the final make-up, or the initial break-out torque to the connection.

At various times during drilling operations, the Iron Roughneck needs to be moved between several locations on the rig, including the well centerline, one or more mouse holes, and a parking or storage position. Movement of the Iron Roughneck can be difficult due to the size and weight of the unit. Existing Iron Roughnecks may be mounted on a trolley that rides on a pair of parallel tracks. The problem with this configuration is that if multiple locations are desired, such as a mouse hole and the centerline stabbing position, extra tracks are necessary. The more tracks on the deck, the more tripping hazards that are created for the rig personnel. If access to a second mouse hole is desired, then there could be three sets of tracks all converging on a single point.

A second type of Iron Roughneck-positioning device is a telescopic arm, or scissor arm. This type of arm uses hydraulics to telescope the roughneck to the desired location. These telescopic arms are costly and heavy, and they take up substantial space when retracted to the stored or parked position.

A third type of Iron Roughneck-positioning device is a suspended parallelogram apparatus where the Iron Roughneck is suspended from the derrick and a parallelogram device swings the Iron Roughneck into position. Another variation has the Iron Roughneck hanging from an arm mounted on a C-shaped positioning device. The problems associated with these devices are that the distance from the arm base to the pipe is very short, the Iron Roughneck continues to swing after being placed into position (gravity is used to keep it vertical), the Iron Roughneck is difficult to install, the Iron Roughneck is heavy, and the Iron Roughneck is not very adjustable to future positions.

Many of these prior art devices use hydraulic cylinders for lifting and supporting the Iron Roughnecks and thus are susceptible to failure of the cylinders or a power failure. Thus, it would be desirable to have a system that is lightweight, compact in size, easily installed, for the movement of Iron Roughnecks. Such a system could also be used with other drilling tools or equipment which are heavy and/or awkward to move about the drilling rig.

SUMMARY OF THE INVENTION

The invention relates to an apparatus for moving an Iron Roughneck into position to allow the making-up and breaking-out of threaded joints in a drill string. The Iron Roughneck may be positioned about the centerline of the well, as well as one or more mouse holes. A self-balanced, dual synchronized parallelogram arm is utilized to accomplish the movement of the devices. Hydraulic or pneumatic cylinders are used for extension and retraction of the arm rather than to support the weight of the tool. The arm holds the tool in any position without cylinder assistance. Additionally, the arm holds the device in the vertical position at all extension points. Further, the arm moves the device parallel to the drill floor. The linkage in the synchronized parallelogram may be accomplished using gears, links, slots, or rollers. The apparatus may also be used to move other equipment into position about the drilling rig, such as the centerline of the well or the mouse holes.

BRIEF DESCRIPTION OF THE DRAWINGS

The following figures form part of the present specification and are included to further demonstrate certain aspects of the present invention. The invention may be better understood by reference to one or more of these figures in combination with the detailed description of specific embodiments presented herein.

DESCRIPTION OF ILLUSTRATIVE EMBODIMENTS

The following examples are included to demonstrate preferred embodiments of the invention. It should be appreciated by those of skill in the art that the techniques disclosed in the examples which follow represent techniques discovered by the inventor to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention. Moreover, although the present invention is discussed in the following paragraphs by reference to positioning an Iron Roughneck on a drilling rig, it will be apparent from the present disclosure that the positioning device of the present invention should not be limited to positioning tools on a drilling rig.

Figure 1:
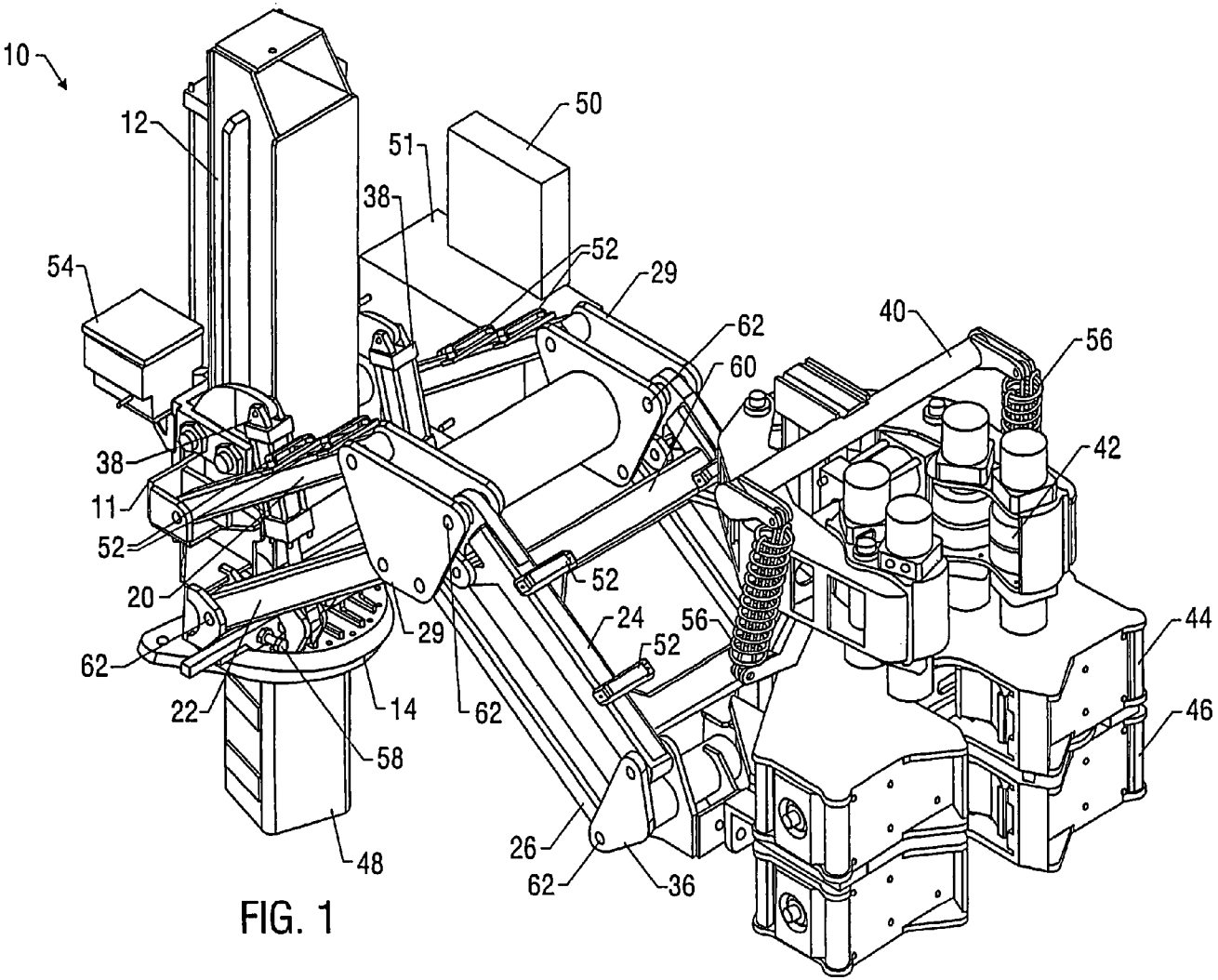
FIG. 1 is an isometric view of the arm and Iron Roughneck assembly.

FIG. 1 represents an isometric view of one embodiment of the invention. The arm assembly 10 comprises a column 12 on which rides a column guide 11. The base of the column 12 comprises a stem 48 that may be stabbed into a receptacle located on the drill floor, and a bearing 14 used for rotation. Instead of a stem, the base may just have a flange that is bolted to the drill floor or may be simply welded to the drill floor. Attached to the column guide 11 is at least one parallelogram arm, which comprises a tension link 20, a lower support arm 22, an upper support arm 24, and a compression link 26. The upper and lower support arms 24,22 may be attached by one of several mechanisms as shown in FIGS. 3-6.

Figure 5A:
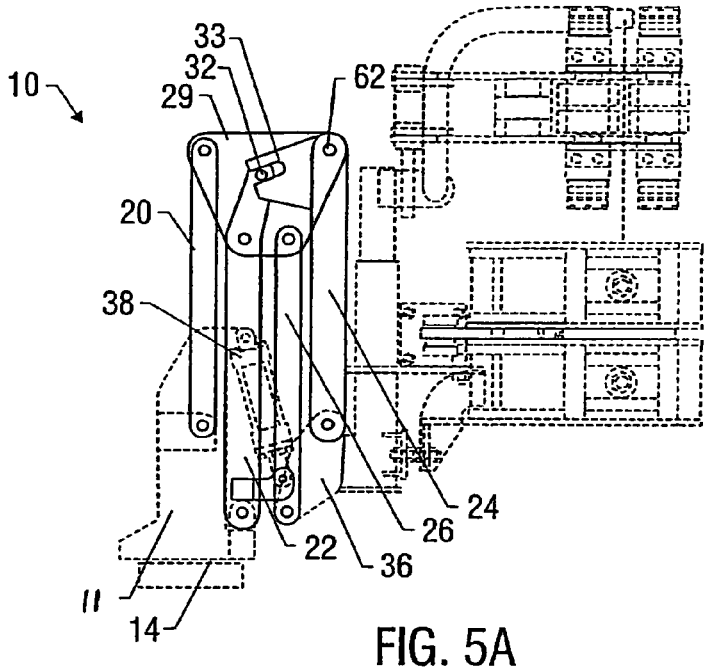
FIGS. 5A and 5B show the synchronized pin and slot arm connection in the retracted and extended positions.
Figure 5B:
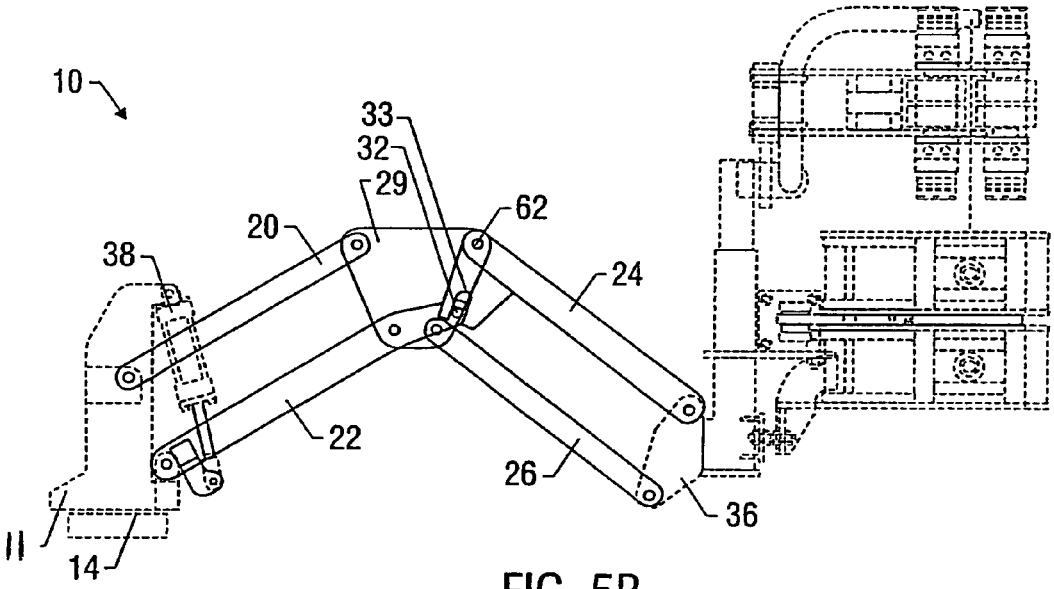
Figure 6A:
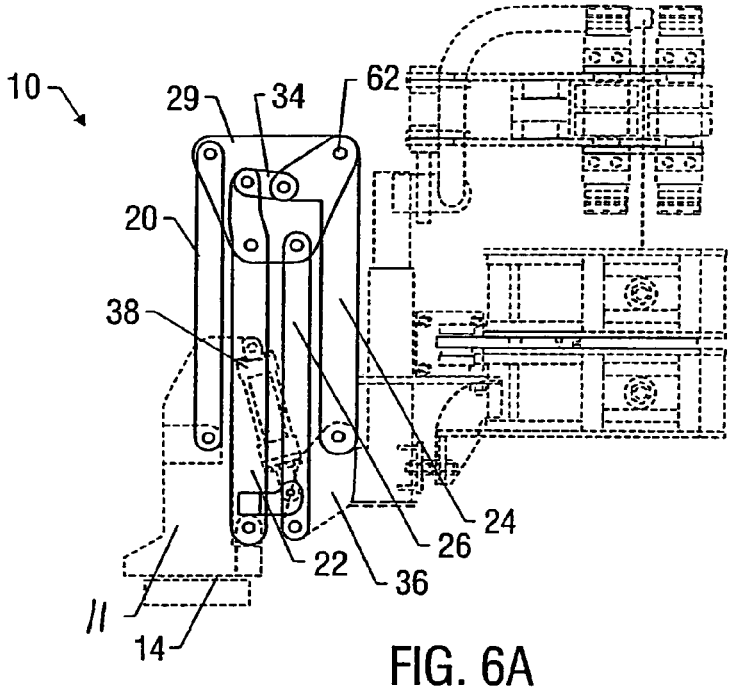
FIGS. 6A and 6B show the synchronized link arm connection in the retracted and extended positions.
Figure 6B:
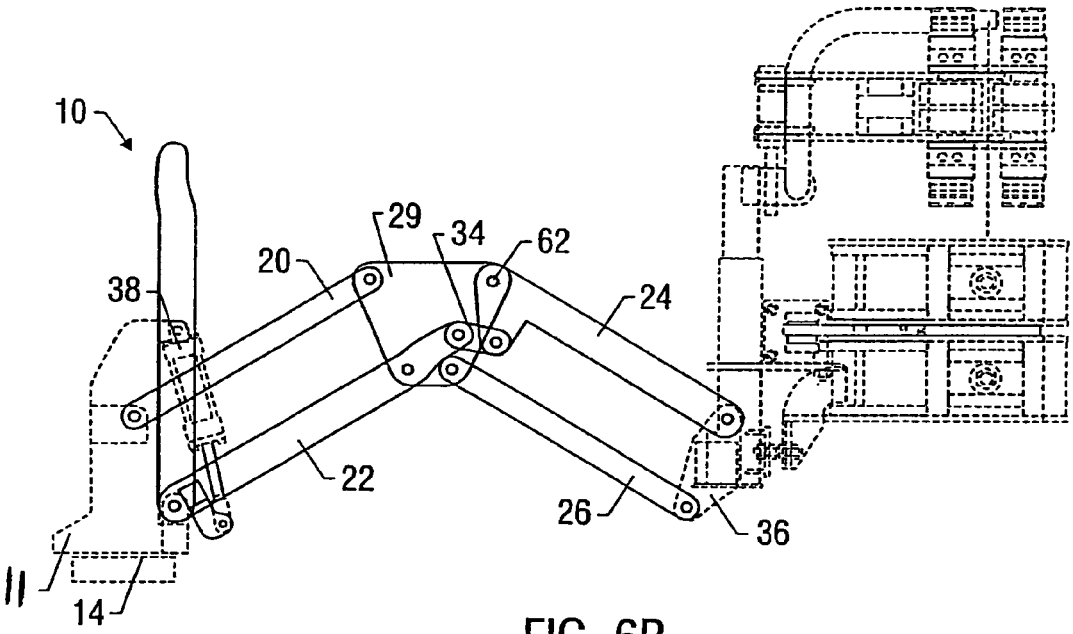

The attachment means may consist of a gear arm connection 28 (FIG. 3A-3B), roller arm connection 30 (FIG. 4A-4B), pin and slot arm connection 32 (FIG. 5A-5B), or a link arm connection 34 (FIG. 6A-6B). The load transfer joint 29 attaches the various support arms and links together. An extension/retraction cylinder 38 is used to move the arm out to various distances from the vertical storage position. If more than one arm is used, one or more braces 60 may be used to connect them.

At the end of the upper load support arm 24 and the compression link 26 is a tool or wrench bracket 36. Attached to the tool bracket is the Iron Roughneck that comprises a spinner 42, a top wrench 44, and a bottom wrench 46. A spinner bracket 40, and springs 56, may also be present. The spinner bracket 40, and springs 56 are used to assure that all rollers on the spinner 42 are touching the pipe, and allows the spinner to move down the pipe as the tool joint is made up. If the spinner is opened, it will move back away from the pipe.

Figure 2:
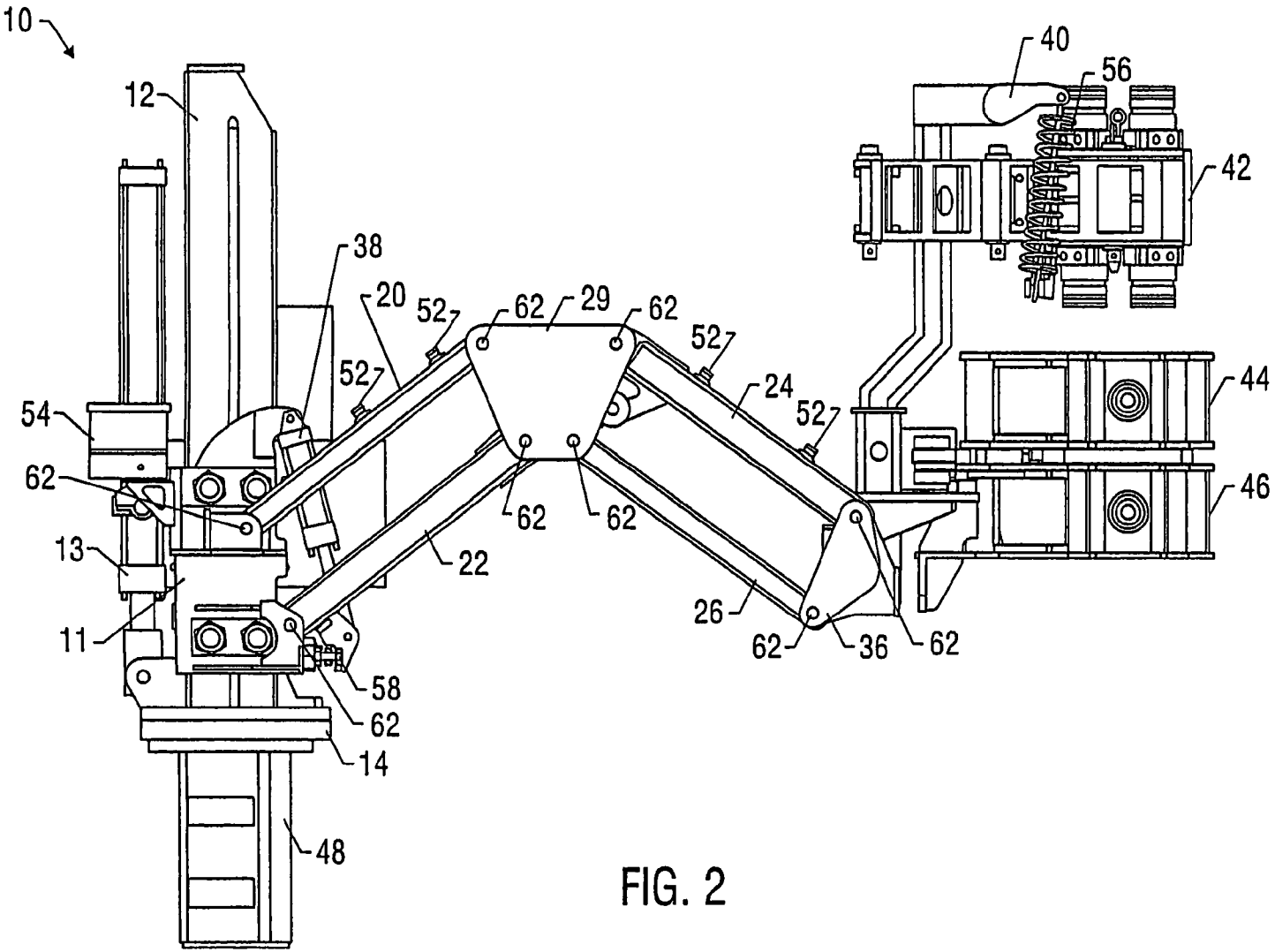
FIG. 2 is a profile view of the arm and Iron Roughneck assembly.

In order to raise and lower the arm assembly along the column 12, a lifting cylinder 13 as shown in FIG. 2 is used. The lifting cylinder 13 is preferentially hydraulically actuated. One of skill in the art, however, will recognize that the cylinder 13 may also be pneumatically actuated. The lifting cylinder 13 may raise the column guide 11 to a height determined by an electrical stop 54 if a programmable logic controller (PLC) is used with a sensor to determine the location of the pipe joint. A manual stop may also be used without the need for a PLC. For example, to control the distance of the Iron Roughneck from the column 12, a mechanical stop 58 may be used. There may be more than one mechanical stop 58 for the different positions of the arm such as the center well, or mouse holes. The arm assembly 10 may include both electrical and mechanical stops.

A torque setting control panel 50 may be utilized to control various movements of the arm. A hydraulic enclosure 51 may house valves and solenoids for the various hydraulic houses needed to control the functions of the Iron Roughneck and the arm. The hoses (not shown) used by the Iron Roughneck may be attached to the arms by clips 52 to allow for a safer and less cluttered path out to the roughneck.

The arm joints 62 may comprise brass bearings, plastic bearing, non-lubricated bearings, and or bushings and compression sleeves. The arm joints 62 comprise the joints on the tool bracket 36, the load transfer joint 29, and those connecting the arms to the column guide 11 (not all joints are labeled on the Figs.).

The arm assembly 10 of the present invention is self balanced which allows the arm to be moved into a certain position and remain stable (stationary) without the need of a positioning cylinder 38. The arm also does not need to be supported by a cylinder. Cylinders 38 are only used for extension or retraction of the arm. This is an advantage because if there is a failure of a support cylinder, or a power failure, the arm may fall, or be left in an extended position. This has both safety and economical ramifications because a falling arm could injure people or damage equipment, and an extended, un-retractable arm may itself impede the drilling operation by blocking the drill floor.

Another feature of a preferred embodiment of the present invention is the ability to move the Iron Roughneck to all extension points of the arm while keeping it in a constant vertical position. Thus, once the Roughneck is mounted on the arm and oriented into the correct vertical position, no further adjustments are necessary to engage the drill pipe joints in their normal positions. Because the Iron Roughneck is always vertical, unlike with the hanging and swinging prior art devices, there is no time wasted while waiting for the Iron Roughneck to stop swinging before engaging the pipe.

An additional feature of the arm is the ability to move the Iron Roughneck parallel to the drill floor. Unlike some of the hanging or swinging systems in the prior art, the arm in the present invention provides additional safety by keeping the iron roughneck the same distance off of the drill floor at all points so that the pipe may be made-up at substantially the same height.

Figure 3A:
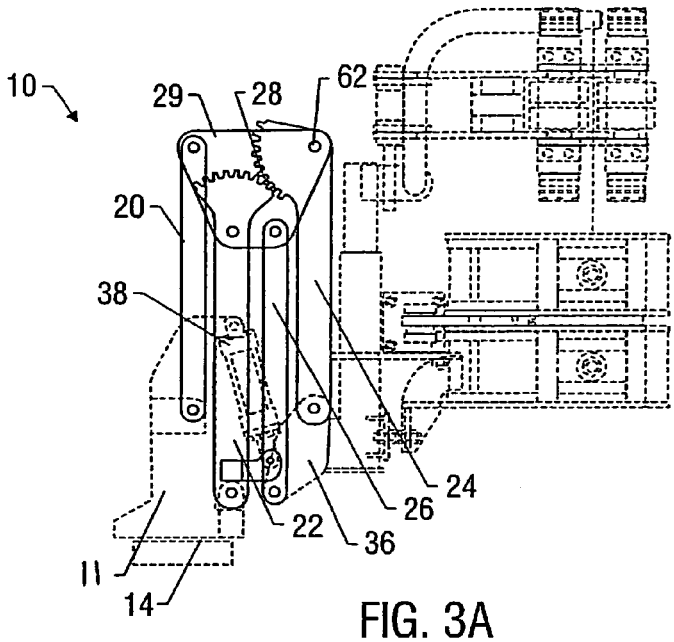
FIGS. 3A and 3B show the synchronized gear arm connection in the retracted and extended positions.
Figure 3B:
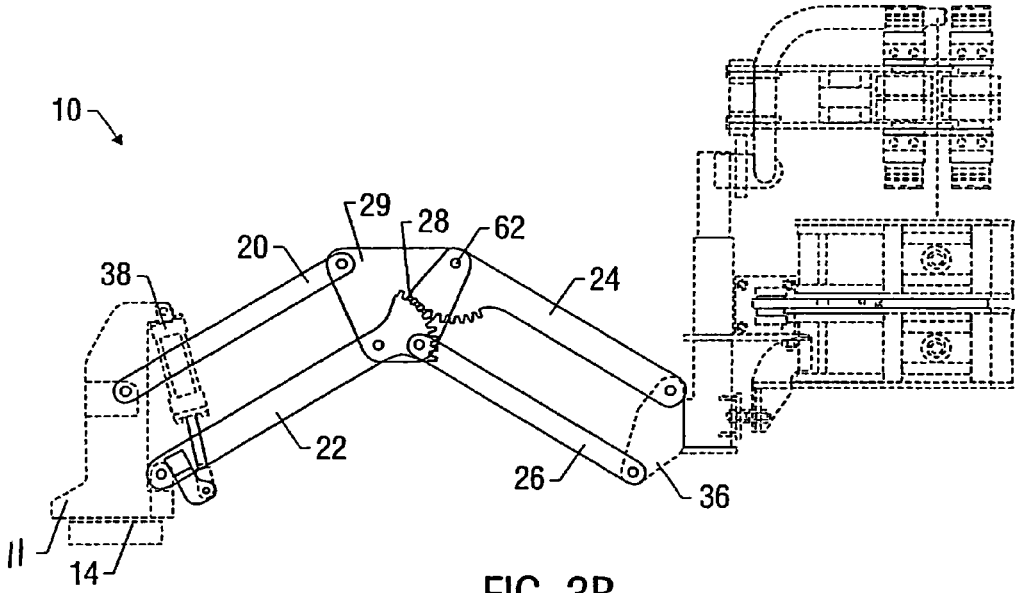

In one embodiment of the present invention, as shown in FIGS. 3A and 3B, the attachment means for the upper and lower support arms 24,22 is a synchronized gear 28. Typically, the arms of the other embodiments of the present invention described below have a range of motion between about 0° and about 60°, with 0° being the vertical, retracted position shown in FIG. 3A. The synchronized gear arm is not limited to 60°—it is limited only by the number of "teeth" in the gears as shown in FIGS. 3A and 3B.

Figure 4A:
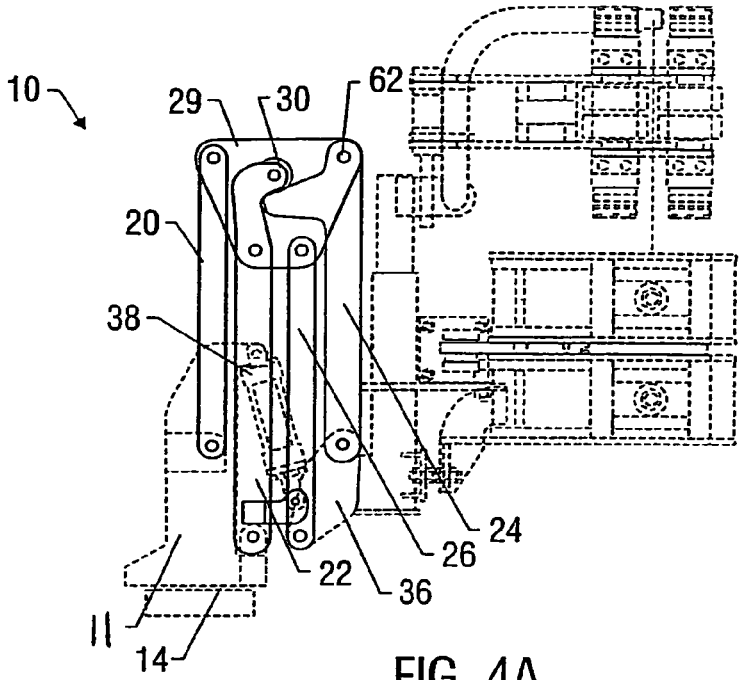
FIGS. 4A and 4B show the synchronized roller arm connection in the retracted and extended positions.
Figure 4B:
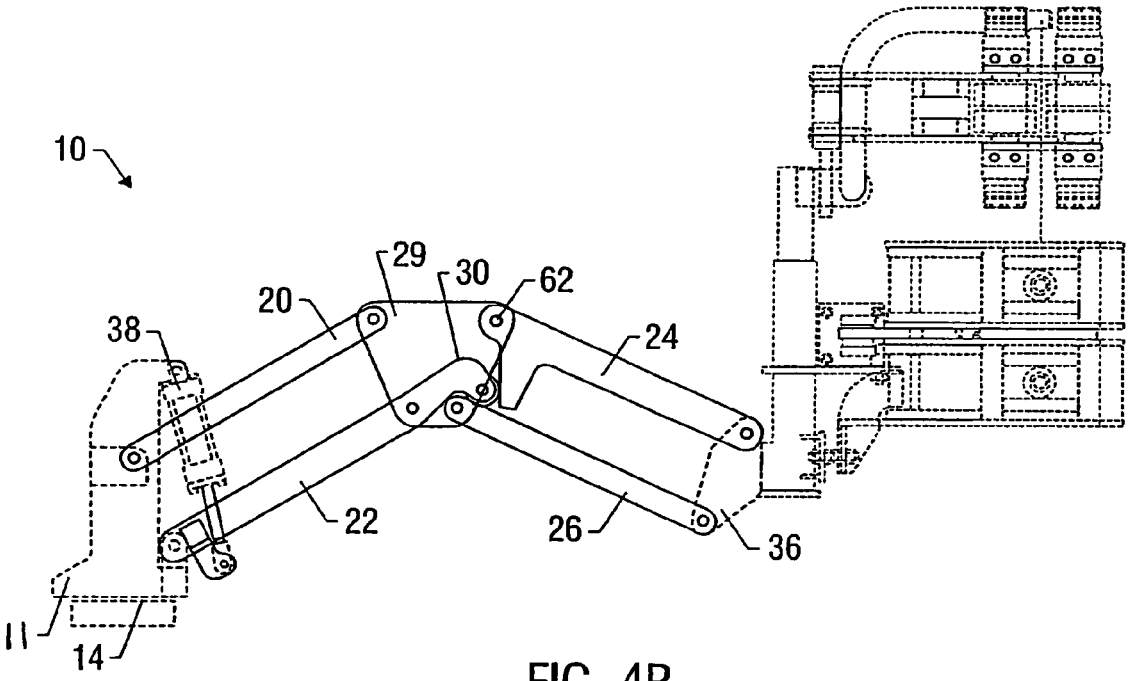

A second embodiment utilizing a roller connection 30 is shown in FIGS. 4A and 4B. A roller may be used because there is never an upward force, only a downward force. Preferably, the roller is made of steel. The roller rolls about an extended surface on upper support arm 24 during movement of the arm.

A third embodiment utilizes a pin 32 and slot 33 attachment as shown in FIGS. 5A and 5B. The slot 33 may be an open slot as depicted in FIGS. 5A-B, but the use of a mechanical stop 58 (as shown in FIGS. 1 and 2) is necessary to keep the arms from coming apart. It is possible to also utilize a closed slot (not shown) that would not require a mechanical stop. Pin 32 slides within slot 33 during movement of the arm. A fourth embodiment utilizes a synchronized link 34 as shown in FIGS. 6A and 6B.

In all of the embodiments described above, the entire parallelogram arm may be inverted, that is, rotated about its longitudinal axis 180 degrees so that the load transfer joint 29 is essentially located on the bottom of the parallelogram arm.

Typically, the desired working height above the drill floor is about 30 inches. Most of the time, the working height for the Iron Roughneck is about 30 inches to about 60 inches. The arms of the present invention typically have a horizontal reaching distance of about 55 inches to about 8 feet. If a longer reach is desired, longer support arms and links may be used.

The arms and links are connected by the use of bushings and pins 62. The arm joints 62 may comprise brass bearings, plastic bearing, non-lubricated bearings, compression sleeves and/or bushings—typically, the bushings are bronze or plastic and the pins are stainless steel. The arm joints 62 comprise the joints on the tool bracket 36, the load transfer joint 29, and those connecting the arms to the column guide 11 (not all joints are labeled on the Figs.).

If the frictional resistance is low enough, the arm may be extended or retracted using conventional, non-hydraulic means such as having a rig operator manually pull or II push the arm into position. However, the preferred embodiment uses one or more hydraulic cylinders 38 to overcome frictional resistance to move the arm between various positions about the rig floor.

The arm of the present invention may be utilized to position other types of equipment on a rig such as a mud bucket, casing tong, thread doper, and stabbing arm. Such devices are well known in the drilling industry. The equipment may be mounted directly to the positioning arm of the present invention, or to the Iron Roughneck already attached to the positioning arm. The mud bucket is used when pulling wet strings to provide a cleaner drill floor by capturing mud and returning it to the mud system. Mud buckets also allow the reuse of expensive mud. A thread doper cleans the box and adds dope to the drill pipe threads. It may be operated remotely and allows for the consistent application of thread dope. It also reduces the dope consumption. A stabbing arm may also be attached to the arm—that device controls the positioning of pipe for stabbing.

In an additional embodiment, the height adjustment for the Iron Roughneck is located at the end of the arm rather than at the base of the arm. In a further embodiment, column 12 may be attached to the derrick to eliminate any movement applied to the base of the arm assembly at the drill floor.

While the apparatuses and methods of this invention have been described in terms of preferred or illustrative embodiments, it will be apparent to those of skill in the art that variations may be applied to the process described herein without departing from the concept and scope of the invention. All such similar substitutes and modifications apparent to those skilled in the art are deemed to be within the scope and concept of the invention as it is set out in the following claims.

What is claimed is:

1. An apparatus for moving drilling equipment comprising:

a column attached to a drill floor;

a column guide attached to the column;

at least one parallelogram arm attached to the column guide at a first connection point, the at least one parallelogram arm comprising a tension link, a lower support arm, an upper support arm, a compression link, and a load transfer joint;

a drilling apparatus attached to the parallelogram arm at a second connection point; and a cylinder attached to the column guide for raising and/or lowering the column guide along the column.

2. The apparatus of claim 1 further comprising a cylinder attached to the column guide and parallelogram arm for extending and/or retracting the parallelogram arm.

3. The apparatus of claim 1, wherein the column is adapted to allow for radial motion of the at least one parallelogram arm.

4. The apparatus of claim 1, wherein the column is stabbed into a receptacle located on the drill floor.

* * * * *